United States Patent [19]

Kemeny

[11] Patent Number: 4,901,620

[45] Date of Patent: Feb. 20, 1990

[54] ELECTROMAGNETIC LAUNCHER SYSTEMS FOR PENETRATORS AND LARGER CALIBER PROJECTILES

[75] Inventor: George A. Kemeny, Wilkins Township, Allegheny County, Pa.

[73] Assignee: Westinghouse Electric Corp., Pittsburgh, Pa.

[21] Appl. No.: 350,940

[22] Filed: Feb. 22, 1982

[51] Int. Cl.[4] ..... F41F 1/02

[52] U.S. Cl. ..... 89/8

[58] Field of Search ..... 89/8; 124/3

[56] References Cited

U.S. PATENT DOCUMENTS

| | | | |
|---|---|---|---|
| 1,355,841 | 10/1920 | Morse | 89/1 L |
| 1,370,200 | 3/1921 | Fauchon-Villeplee | 124/3 |
| 4,319,168 | 3/1982 | Kemeny | 124/3 |
| 4,347,463 | 8/1982 | Kemeny et al. | 124/3 |
| 4,369,692 | 1/1983 | Kemeny | 89/8 |

OTHER PUBLICATIONS

S2049 0050, IEEE Trans. on Magnetics, vol. Mag-18, (1/82) Brooks et al., pp. 68-81, "Design and Fabrication of Large and Small Bore Railguns".

*Primary Examiner*—Sal Cangialosi

*Attorney, Agent, or Firm*—R. P. Lenart

[57] ABSTRACT

An electromagnetic launcher system for small diameter high velocity penetrator projectiles and larger diameter, slower projectiles is provided with a single high current pulse power supply. At least two bores of substantially different cross section are connected to the power supply. Augmentation conductors are utilized adjacent the larger diameter bore to achieve the desired acceleration of the large diameter projectile with a smaller root mean square current than used for the acceleration of the small diameter projectile to a desired high velocity.

13 Claims, 3 Drawing Sheets

ELECTROMAGNETIC LAUNCHER SYSTEMS FOR PENETRATORS AND LARGER CALIBER PROJECTILES

BACKGROUND AND SUMMARY OF THE INVENTION

This invention relates to electromagnetic projectile launcher systems and more particularly to such systems which utilize a single high current power supply to supply current to at least two pairs of launcher rails where the pairs of launcher rails form at least two bores of substantially different cross sectional area for the propulsion of projectiles having substantially different diameters and masses.

Conventional chemical propulsion artillery such as tank cannons are of relatively large bore size, in the vicinity of 110 millimeters, but must be capable of firing small diameter high velocity penetrators as well as large caliber high explosive projectiles. Though penetrators are generally of rather small diameter, the large bore size is required so that pressure generated by conflagration of the chemical propellant acts on a sufficiently large base area to develop adequate force to attain the desired projectile exit velocity in the available barrel length. In the case of penetrating projectiles, the propelling pressure is exerted against the base of a bore sealing sabot which encloses or carries the penetrator. This sabot structure falls away a short distance beyond the muzzle. Large caliber projectiles are inherently shorter and fill the bore, therefore no sabot is required. The important consideration for chemically propelled projectiles is that the breech pressure is limited for many reasons to a value on the order of 50,000 psi. In order to achieve adequate propulsion forces to accelerate the pay load, rather large diameter bores are required.

In a simple parallel rail electromagnetic launcher, the accelerating force is proportional to the square of the current with rather little dependence on the geometry of the bore configuration as long as it is approximately square. Thus a square bore launcher of for example 40×40 millimeters in size, will for a given current, produce about the same accelerating force as a square bore of doubled dimensions and thus four times the cross sectional area. Since penetrating projectiles are generally of small diameter and must frequently be fired in rapid succession, efficient cannon systems for firing penetrating projectiles such as anti-aircraft projectiles, will utilize the minimum adequate bore size so as to reduce barrel weight, allow faster aiming or laying, reduce armature or sabot weight, decrease barrel inertia effects during vehicle movement, etc. Thus an efficient artillery piece for the electromagnetic launching of small diameter projectiles will utilize small bores which will on the other hand be of insufficient size to launch the heavier and shorter large caliber projectiles.

In order to provide an electromagnetic launcher system which is capable of efficiently firing small diameter penetrating projectiles in rapid succession and large diameter projectiles at a slower repetition rate, a launcher constructed in accordance with the present invention utilizes a single kinetic energy-inductive pulse power system to supply launching current to two separate cannons. Therefore an electromagnetic projectile launching system in accordance with the present invention includes a single high current pulse power supply, at least two barrels each having at least one pair of conductive rails for accelerating projectiles, means for conducting current between the rails of each barrel and for propelling a projectile along the barrels, and means for commutating the current from the high current source to the breech end of each of the barrels. In an alternative embodiment, a single barrel can be utilized which includes at least two bores of subtantially different cross sectional area. Each of the bores includes at least one pair of projectile launching rails. In addition, means for conducting current between these rails and for propelling a projectile along the rails is provided. In each embodiment of this invention, augmenting rails can be utilized along the bore having the largest cross sectional area so that adequate forces to accelerate a heavier large caliber projectile can be obtained at about the same current levels as used for the penetrating projectiles in the small bores.

DESCRIPTION OF THE PREFERRED EMBODIMENT

Figure 1:
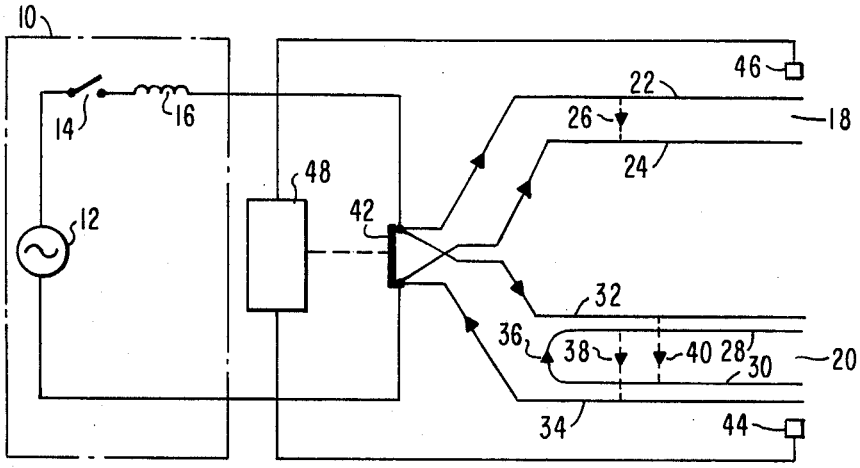
FIG. 1 is a schematic representation of an electromagnetic launching system in accordance with one embodiment of the present invention.

Referring to the drawings, FIG. 1 is a schematic representation of an electromagnetic launcher system in accordance with one embodiment of the present invention. High current power supply 10 comprises the series connection of homopolar generator 12, switch 14 and inductor 16. Power supply 10 is connected to a parallel arrangement of a small diameter, high velocity penetrator projectile bore 18 and a large diameter projectile bore 20. Small diameter penetrator projectile bore 18 is formed by the generally parallel arrangement of conductive rails 22 and 24. Armature conductor 26 serves as a means for conducting current between conductive rails 22 and 24 and for propelling a projectile through bore 18. Large caliber projectile bore 20 is formed by the generally parallel arrangement of conductive rails 28, 30, 32 and 34 in an internally augmented configuration. Rails 28 and 30 are connected at the breech end by shunt 36. An armature with two conductors 38 and 40, serves as means for conducting current between large caliber rails 28 and 34 and rails 32 and 30 respectively, and as means for propelling a projectile along bore 20. Bores 18 and 20 are electrically connected in parallel to high current power supply 10, however, other electrical connections are also within the scope of this invention. Contactor 42 connected across the breech ends of bores 18 and 20, serves as a means for commutating current from high current source 10 into the rails along bores 18 and 20. In the operation of this launcher system, contactor 42 is initially closed and switch 14 is closed allowing homopolar generator 12 to charge inductor 16 to a preselected current. When a launch is to be made, contactor 42 is opened rapidly commutating current into the launcher rails. Armature conductor 26 or the armature with two conductors 38 and 40 would be inserted into the appropriate bore depending on the type of projectile to be launched just prior to the opening of contactor 42. In order to achieve automatic launcher performance, sensors 44 and 46 are located near the muzzle end of barrels 20 and 18 respectively and are used as sensing means for detecting the passage of a projectile past a given point. At that time, the sensors provide a signal to contactor reclosing means 48 which closes contactor 42 allowing generator 12 to recharge inductor 16 to the desired predetermined current level for a successive shot.

Figure 2:
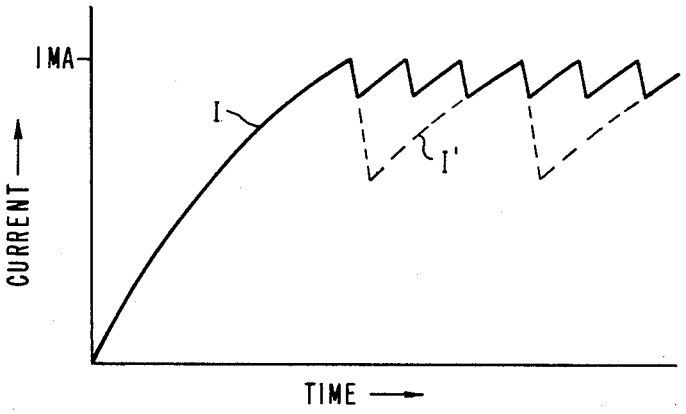
FIG. 2 is a plot of current versus time, illustrating the current flow in the launcher of FIG. 1.

FIG. 2 is a plot of an estimated current versus time for a firing scenario of the launcher of FIG. 1. In this example, one MA is selected as the predetermined firing current. The solid line I illustrates the initial current increase to firing level and the current flow in the launcher of FIG. 1 for rapid burst firing of small diameter high velocity penetrator projectiles using bore 18. Broken line I' illustrates the current flow during the firing of a large caliber projectile using bore 20. Because of the much higher energy dissipation per shot, the current drop during the firing of a large caliber heavy projectile will be quite substantial and inductor 16 must be sized in order to provide sufficient energy to achieve the desired exit velocity for the large caliber projectile. The firing of the high velocity penetrator projectile will only result in a minor current drop, therefore a faster recharging and a far faster firing rate is possible. It is apparent from FIG. 2 that small diameter penetrator projectiles can be burst fired while large diameter and heavier projectiles must be fired at a lower repetition rate.

Figure 3:
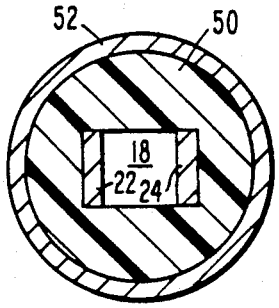
FIG. 3 is a cross section of the small diameter penetrator projectile bore of the launcher of FIG. 1.
Figure 4:
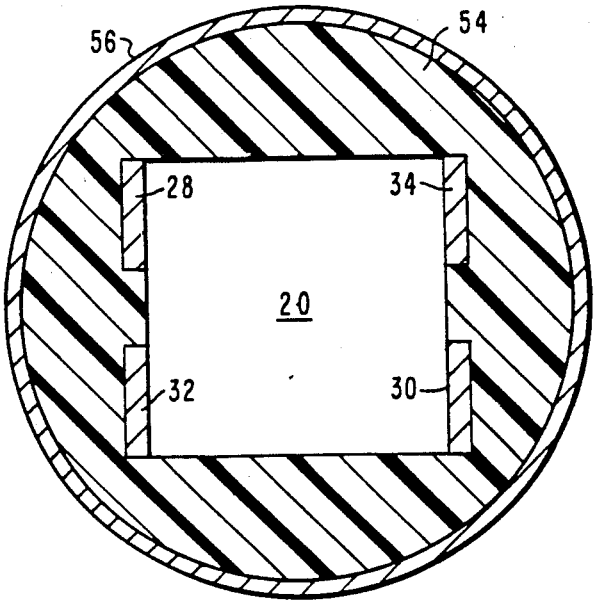
FIG. 4 is a cross section of the large diameter bore of the launcher of FIG. 1.

FIG. 3 is a cross sectional view of bore 18 of the launcher of FIG. 1. Generally parallel conductive rails 22 and 24 are held in place by generally rigid insulation 50 which is enclosed in cylinder 52, which may, for example, consist of a structure including glass or graphite fibers. During a launch, armature conductor 26 of FIG. 1 which may be a conductive material or an arc, associated with an insulating bore sealing sabot, conducts current between rails 22 and 24 and propels a projectile along bore 18 from the breech end to the muzzle end. FIG. 4 is a cross sectional view of bore 20 of the launcher of FIG. 1. Generally parallel conductive rails 28, 30, 32 and 34 are shown in an internally augmented configuration and are held in place by insulating material 54. The entire barrel is enclosed in cylinder or confining structure 56. During a launch, the single armature with two conductors 38 and 40 of FIG. 1 would conduct current between rails 28 and 34 and rails 32 and 30 respectively and propel a projectile along bore 20 from the breech end to the muzzle end.

Figure 5:
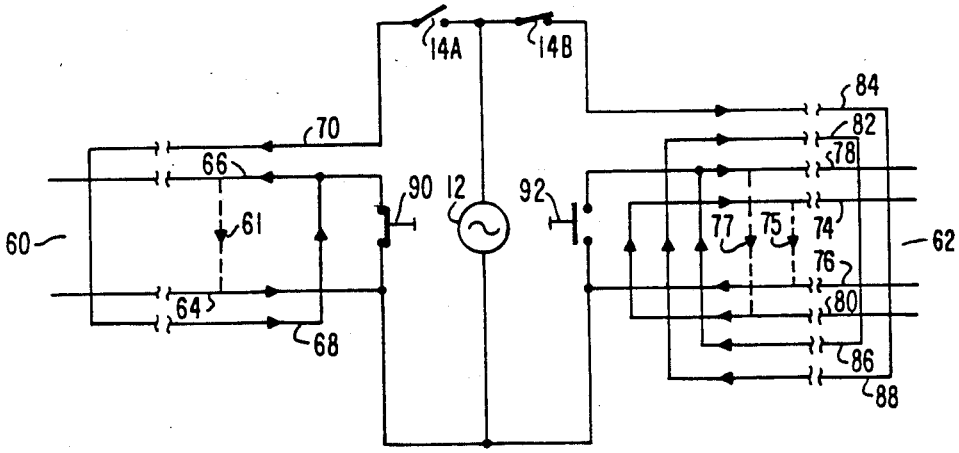
FIG. 5 is an alternative embodiment of a launcher in accordance with the present invention wherein external augmenting conductors are additionally utilized for each bore.

In order to reduce the propulsion current level or to eliminate the need for or reduce the size of the external inductive store, and also to reduce the magnetic field external to the barrel array, a coaxial, multi-bore barrel array can be used. Continuing with the concept of two separate barrel arrays, FIG. 5 illustrates an electromagnetic launching system in which each barrel array utilizes an externally augmented design. Generator 12 supplies current to barrels 60 and 62 through switches 14A and 14B respectively. Barrel 60 includes generally parallel projectile launching rails 64 and 66 and external augmenting conductors or rails 68 and 70. The external augmenting conductors or rails are arranged adjacent the barrel launching rails and connected such that current flow through the augmenting conductors is in the same direction as in the closer projectile launching rail. Armature conductor 61 conducts current between rails 64 and 66 during a launch. Barrel 62 includes the internally augmented configuration of the four generally parallel projectile launching rails 74, 76, 78 and 80. External augmenting conductors 82, 84, 86 and 88 are arranged adjacent the projectile launching rails and connected such that current flow through the augmenting conductors is in the same direction as current flow through the closest projectile launching rail. Armature conductors 75 and 77 conduct current between rails 74 and 76 as well as 78 and 80 respectively during a launch. Firing switches 90 and 92 serve as means for commutating high current into barrels 60 and 62 respectively. Although only one bore is shown for each firing switch of FIG. 5, it should be understood that a number of electrically in parallel connected launcher bores may be connected across each firing switch. In that case, the bore which has an armature shorting its breech when the appropriate firing switch opens, will fire. Switches 14A and 14B are used to select the barrel system which is to be fired. In this launcher, inductive energy is stored in the augmenting conductors. If additional inductive energy storage is required, an inductor may be inserted in series with switches 14A or 14B as appropriate. The launcher of FIG. 5 is illustrative of a multiple barrel launcher system employing a single kinetic energy storage device such as a homopolar pulse generator. The use of a single pulse generator power supply represents a substantial size, weight and cost reduction for a launching system which must be highly mobile.

Figure 6:
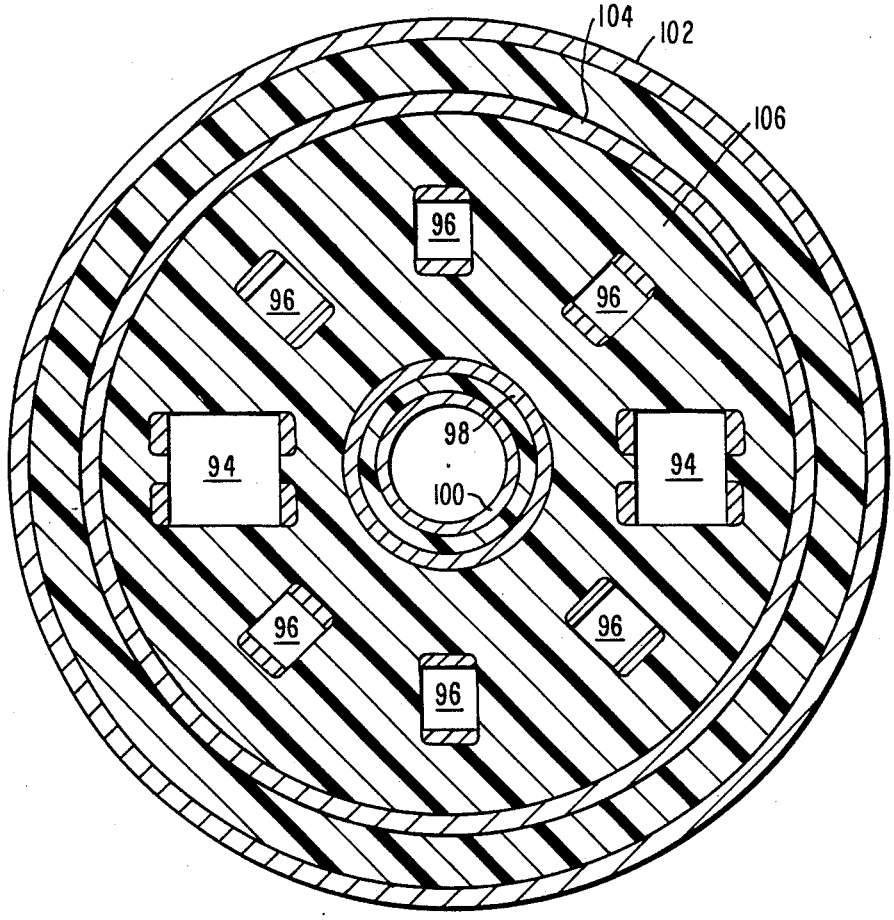
FIG. 6 is a cross sectional view of a launcher in accordance with the present invention employing a single barrel with multiple bores of varying sizes.

FIG. 6 is a cross sectional view of a multiple bore launcher employing a single barrel in accordance with an embodiment of the present invention. Multiple bores 94 and 96 are located within external cylindrical augmenting conductors 102 and 104 and exterior to internal cylindrical augmenting conductors 98 and 100. Rigid insulating material 106 holds the conductive rails for bores 94 and 96 in place. Cylindrical or tubular coaxial augmenting conductors 98, 100, 102 and 104 provide substantial inductive storage for the launcher. However if additional inductive storage is required, an inductive element can be placed in series with the power supply.

One important feature of the FIG. 6 design is that it substantially reduces external magnetic fields during launching, thereby reducing the likelihood of detection by opponents. It should however be understood that a multiple bore array as illustrated in FIG. 6 is also feasible where the augmenting conductors are not utilized.

The multi-bore array as shown in FIG. 6 can be fired using only a single firing switch as illustrated in FIG. 1. This requires that the launch conductors of all bores must be electrically in parallel across the switch. When the switch is opened, one armature must be concurrently pushed into one bore to short its breech so that the opening of the switch commutates the firing current into that breech loop. Suitable sensing means as shown in FIG. 1 are also required to detect when the projectile is at or near the muzzle so as to initiate reclosure of the firing switch to allow recharging of the inductive store back to the firing level. Then the launcher will fire a projectile as soon as the current has again reached a predetermined firing level. That level would be sensed by suitable instrumentation which would initiate the firing switch opening. If the switch opens without a projectile armature shorting across the breech, then corrective measures must be quickly initiated to prevent switch failure. The actual loading sequence may involve placement of projectile armature assemblies with their projectiles in insulated bore extensions at the breech and pushing them forward singly into the conductive breech just prior to acceleration or during the opening of the firing switch. The severe switching obligations imposed during burst firing are more likely to be met by an array of parallel synchronized switches or by using an array of switches which are successively or alternately operated. The firing switch may also consist of one or more switches which conduct the massive current during its build up to the firing level and opening of such switches may then commutate the current initially into other devices which are subsequently opened to finally commutate the current into the breech in what may be termed a two step commutation procedure.

By way of further example the relevant parameters for the launch of a 200 gram high velocity penetrator projectile and an 8000 gram larger caliber projectile using the launcher configuration shown in FIG. 1 have been estimated. The assumed penetrator projectile bore is as shown in FIG. 3 with an assumed inductance gradient of 0.5 microhenries per meter for the simple parallel rail configuration. The large caliber bore is assumed to be as shown in FIG. 4. Each of the bores is four meters in length and the firing current at the breech is assumed to be 1000 kA. Using these parameters, the penetrator projectile is estimated to achieve an exit velocity of 3000 meters per second at an estimated exit kinetic energy of 0.90 MJ. The accelerating time estimate is 2.67 milliseconds and the root mean square current estimate is 948.7 KA. Following the launch, the muzzle current estimate is 896 kA. The larger caliber projectile would achieve an estimated exit velocity of 800 meters per second with an estimated exit kinetic energy of 2.56 MJ. The accelerating time of the larger caliber projectile is estimated to be 10 milliseconds and the root mean square current is estimated at 800 kA. Following the launch of the larger caliber projectile the muzzle current estimate is 582 kA. It should be noted that the value of root mean square current for the larger caliber projectile is actually lower than that for the penetrator because of the higher energy dissipation involved in launching from the large caliber bore. Therefore by suitable force augmentation of the heavier projectile bore, a comparable root mean square current level can successfully propel either a high velocity low weight penetrator or a 40 times heavier projectile to lower but still respectable velocity. In order to achieve a muzzle current value of about 580 kA in about 10 milliseconds for this larger caliber projectile launch, an inductance in the vicinity of 20 microhenries is required. Were it not for the larger caliber projectile acceleration requirement, the inductor could be of considerably lower inductance for just the high velocity penetrator acceleration.

Even though the firing scenario represented by this example was arbitrarily selected, other firing scenarios involving a high velocity small bore launcher and a low velocity larger bore launcher are amenable to a similar solution. That is, accelerating the high velocity projectile in a simple parallel rail configuration preferably utilizing arc drive and accelerating the slower high mass projectile in an internally series augmented barrel configuration so that the root mean square current required for the latter acceleration will be below the current for the high velocity condition. If the high mass slower projectile has to be accelerated to an even higher kinetic energy ratio with respect to the high velocity penetrator than given in the example, then triple internal series augmentation may have to be employed. For example, assume that the projectile weight is doubled to 16 kilograms and that the muzzle velocity of 800 meters per second is still to be attained in a four meter barrel. Using triple series augmentation (three parallel projectile rail pairs and three insulated conduction paths for the armature) this more extreme prerequisite can be estimated to require an RMS current level of about 750 kA and of course, a higher inductive energy storage and higher homopolar kinetic energy storage as each projectile now has a 5.12 MJ muzzle kinetic energy. In order to reduce the propulsion current level, to eliminate the need for or reduce the size of the external inductive store and to reduce the magnetic field external to the barrel array a coaxial, multi-bore, augmented barrel can be used.

It should be understood that if the high velocity projectile is to be arc or plasma driven, then a shorted breech current loop must be established to permit commutation of the current into the breech. This may be accomplished, for example, by a fusible wire or ribbon element or elements located at the rear face of an insulating and bore sealing sabot. This fuse element acts initially as a short, thus allowing current commutation. When the fuse element explodes, an arc or plasma which thereafter drives the projectile assembly is initiated.

What is claimed is:

1. An electromagnetic projectile launcher comprising:

a single electric current pulse power supply;

a first barrel having a breech end and a muzzle end and including a first pair of parallel conductive rails for accelerating a first projectile having a first mass;

a second barrel having a breech end and a muzzle end and including a second pair of parallel conductive rails for accelerating a second projectile having a larger mass than said first projectile;

means for conducting current between said first pair of rails and for propelling said first projectile from the breech end to the muzzle end of said first barrel;

means for conducting current between said second pair of rails and for propelling said second projectile form the breech end to the muzzle end of said second barrel; and means for commutating current from said electric current pulse power supply to said first and second pairs of rails, wherein, at a preselected firing current level, the accelerating force applied to said second projectile is a multiple of the accelerating force applied to said first projectile.

2. An electromagnetic projectile launcher as recited in claim 1, wherein said means for commutating current comprises:

a first switch connected adjacent said breech end of said first barrel; and a second switch connected adjacent said breech end of said second barrel.

3. An electromagnetic projectile launcher as recited in claim 1, further comprising:

a first augmentation conductor disposed adjacent to and carrying current in the same direction as one of said second pair of conductive rails; and a second augmentation conductor disposed adjacent to and carrying current in the same direction as the other one of said second pair of conductive rails.

4. An electromagnetic projectile launcher as recited in claim 1, wherein:

said means for conducting current between said first pair of rails is an arc; and said means for conducting current between said second pair of rails is an armature conductor.

5. An electromagnetic projectile launcher as recited in claim 1, wherein said means for commutating current is a single switch.

6. An electromagnetic projectile launcher as recited in claim 5, further comprising:

sensing means for detecting when a projectile being launched reaches a predetermined position; and means for reclosing said switch in response to said sensing means when said projectile reaches said predetermined position.

7. An electromagnetic projectile launcher comprising:

a single electric current pulse power supply;

a single barrel including at least two bores having different cross-sectional areas;

a first one of said bores including a first pair of generally parallel conductive rails;

a second one of said bores having a larger cross-sectional area than said first bore and including a second pair of generally parallel conductive rails;

means for conducting current between said first pair of rails and for propelling first projectile through said first bore;

means for conducting current between said second pair cf rails and for propelling a second projectile through said second projectile bore, wherein said second projectile has a larger mass than said first projectile; and means for commutating current from said electric current pulse power supply to said first pair of rails and said second pair of rails, wherein at a preselected firing current level, the accelerating force applied to said second projectile is a multiple of the accelerating force applied to said first projectile.

8. An electromagnetic projectile launcher as recited in claim 7, wherein said means for commutating current includes at least one switch.

9. An electromagnetic projectile launcher as recited in claim 7, wherein:

said means for conducting current between said first pair of rails includes at least one arc; and said means for conducting current between said second pair of rails includes at least one armature conductor.

10. An electromagnetic projectile launcher as recited in claim 7, further comprising:

a first cylindrical augmentation conductor; and a second cylindrical augmentation conductor, coaxial with said first augmentation conductor and having an internal diameter larger than the outside diameter of said first augmentation conductor;

said first pair of rails and said second pair of rails being disposed within said second cylindrical augmentation conductor and outside of said first cylindrical augmentation conductor, whereby magnetic flux generated by current flow in said augmentation rails increases magnetic flux in said bores.

11. An electromagnetic projectile launcher as recited in claim 7, further comprising:

a first augmentation conductor disposed adjacent to and carrying current in the same direction as a first one of said second pair of rails; and a second augmentation conductor disposed adjacent to and carrying current in the same direction as a second one of said second pair of rails.

12. An electromagnetic projectile launcher as recited in claim 11, further comprising:

an armature conductor for conducting current between said first and second augmenting conductors and for propelling said second projectile through said second bore; and wherein said means for conducting current between said second pair of rails and for propelling said second projectile through said second bore is a second armature conductor.

13. A method of electromagnetically accelerating a first projectile along a first pair of conductive rails and accelerating a second projectile, having a mass which is larger than the mass of the first projectile, along a second pair of conductive rails, said method comprising the steps of:

switching a preselected current from a single current source to said first pair of conductive rails to produce a first accelerating force on said first projectile;

switching said preselected current from said current source to said second pair of conductive rails to produce a second accelerating force on said second projectile; and augmenting the magnetic flux between said second pair of conductive rails such that said second accelerating force is a multiple of said first accelerating force.

* * * * *